US008446438B2

(12) United States Patent
Weiss

(10) Patent No.: US 8,446,438 B2
(45) Date of Patent: May 21, 2013

(54) METHOD, DEVICE AND SYSTEM FOR TRANSMITTING IMAGE DATA OVER SERIAL SIGNALS

(75) Inventor: Nir Weiss, Herzliya (IL)

(73) Assignee: Samsung Display Co., Ltd. (KR)

( * ) Notice: Subject to any disclaimer, the term of this patent is extended or adjusted under 35 U.S.C. 154(b) by 1414 days.

(21) Appl. No.: 11/885,779

(22) PCT Filed: Mar. 7, 2006

(86) PCT No.: PCT/IL2006/000303

§ 371 (c)(1),
(2), (4) Date: May 7, 2008

(87) PCT Pub. No.: WO2006/095341

PCT Pub. Date: Sep. 14, 2006

(65) Prior Publication Data

US 2010/0110109 A1 May 6, 2010

Related U.S. Application Data

(60) Provisional application No. 60/658,584, filed on Mar. 7, 2005.

(51) Int. Cl.
*G09G 5/02* (2006.01)

(52) U.S. Cl.
USPC ..... 345/694; 345/690; 710/61

(58) Field of Classification Search
USPC ..... 345/690–696; 710/58–61; 358/1.9–3.32; 340/815.55
See application file for complete search history.

(56) References Cited

U.S. PATENT DOCUMENTS

| | | | | |
|---|---|---|---|---|
| 5,822,571 | A * | 10/1998 | Goodrum et al. | 713/400 |
| 6,147,672 | A * | 11/2000 | Shimamoto | 345/589 |
| 6,297,816 | B1 | 10/2001 | Nishitani et al. | |
| 6,587,885 | B1 | 7/2003 | Nakayama et al. | |
| 2003/0231191 | A1 * | 12/2003 | Glen | 345/690 |

FOREIGN PATENT DOCUMENTS

| | | |
|---|---|---|
| WO | WO 02/101644 | 12/2002 |
| WO | WO 2005/076257 | 8/2005 |

OTHER PUBLICATIONS

International Search Report and Written Opinion of PCT/IL06/00303, filed Mar. 7, 2006. Date maile Sep. 21, 2007.

* cited by examiner

*Primary Examiner* — Dmitriy Bolotin
(74) *Attorney, Agent, or Firm* — Innovation Counsel LLP

(57) ABSTRACT

Some demonstrative embodiments of the invention include methods, devices and/or systems to transfer data over serial signals, for example, a method of transferring over serial signals data representing an image to be reproduced, the method including generating a set of one or more data signals including image data received at an image data rate, and generating a transmission clock signal having a clock cycle during which the set of image data signals includes image data of more than one pixel of the image to be reproduced. Other embodiments are described and claimed.

28 Claims, 5 Drawing Sheets

METHOD, DEVICE AND SYSTEM FOR TRANSMITTING IMAGE DATA OVER SERIAL SIGNALS

CROSS-REFERENCE TO RELATED APPLICATIONS

This application is a National Phase Application of PCT International Application No. PCT/IL2006/000303, entitled "METHOD, DEVICE AND SYSTEM OF TRANSMITTING IMAGE DATA OVER SERIAL SIGNALS", International Filing Date Mar. 7, 2006, published on Sep. 14, 2006 as International Publication No. WO 2006/095341, which in turn claims priority from United States Provisional Application No. 60/658,584, filed Mar. 7, 2005, the entire disclosure of which is both of which are incorporated herein by reference in their entirety.

FIELD OF THE INVENTION

The invention generally relates to serial transmission of data and, more particularly, to serial transmission of image data in color display systems, e.g., in liquid crystal display systems.

BACKGROUND OF THE INVENTION

In the filed of digital video data, Low Voltage Differential Signaling (LVDS) streams may be implemented for transmitting data, e.g., image data. For example, in Liquid Crystal Display (LCD) systems it may be required to transfer a large amount of image data at a relatively high data rate. Transferring the image data at a high data rate may result in an increased level of electro-magnetic interference (EMI), e.g., if a parallel interface is used for transferring the image data.

A typical LCD system may implement one or more LVDS streams to transfer image pixel data between an input and a timing controller (TCON) of the LCD system. The LCD system may include, for example, a LVDS transmitter to convert input image data, e.g., including image pixel data in a Complementary-Metal-Oxide-Semiconductor/Transistor-Transistor-Logic (CMOS/TTL) format, into image data in a LVDS format to be transferred over a LVDS stream including, e.g., four or five LVDS data channels. The stream may include an additional LVDS channel ("the clock LVDS channel") to transfer a phase-locked transmit clock ("the LVDS clock") in parallel with the LVDS data channels. Each one of the LVDS data channels may be adapted to transfer 7 bits during each clock cycle of the transmit clock. Accordingly, the LVDS stream may be able to transfer a maximum of 28 or 35 bits during each clock cycle of the transmit clock, e.g., if the stream includes four or five data channels, respectively. A typical LVDS stream may implement a transmit clock having a clock frequency of 135 Mega Hertz (MHz). Accordingly, a single typical LVDS channel may have a maximal data transmission rate of 135*7=945 Mega bit per second (Mbps). A typical LVDS stream including four data channels may have a maximal data transmission rate of 945*4=3.78 Giga bit per second (Gbps), and a typical LVDS stream including five data channels may have a maximal data transmission rate of 945*5=4.72 Gbps.

In conventional LCD systems each pixel is reproduced using three primary colors, namely red (R), Green (G) and Blue (B). Each primary color component may be represented by an 8-bit value.

Typically, the LVDS transmitter transmits data of a whole pixel per LVDS clock. During each clock cycle, the LVDS transmitter transmits 27 bits, including 24 bits representing data of a single pixel, e.g., 8 bits representing the red component of the pixel, 8 bits representing the green component of the pixel, and 8 bits representing the blue component of the pixel; and 3 bits of LCD timing and control data, e.g., representing Data-End (DE), Horizontal Synchronization (HSYNC) and Vertical Synchronization (VSYNC) information. Thus, conventional RGB LCD systems implement only 27/28 of the available bandwidth of the LVDS stream.

For example, the LVDS transmitter may transmit the RGB pixel data in the following format:

TABLE 1

| TX bit | LVDS clock 1 | LVDS clock 2 | ... | LVDS clock L |
|---|---|---|---|---|
| TA0 | D0_R2 | D1_R2 | ... | DL_R2 |
| TA1 | D0_R3 | D1_R3 | ... | DL_R3 |
| TA2 | D0_R4 | D1_R4 | ... | DL_R4 |
| TA3 | D0_R5 | D1_R5 | ... | DL_R5 |
| TA4 | D0_R6 | D1_R6 | ... | DL_R6 |
| TA5 | D0_R7 | D1_R7 | ... | DL_R7 |
| TA6 | D0_G2 | D1_G2 | ... | DL_G2 |
| TB0 | D0_G3 | D1_G3 | ... | DL_G3 |
| TB1 | D0_G4 | D1_G4 | ... | DL_G4 |
| TB2 | D0_G5 | D1_G5 | ... | DL_G5 |
| TB3 | D0_G6 | D1_G6 | ... | DL_G6 |
| TB4 | D0_G7 | D1_G7 | ... | DL_G7 |
| TB5 | D0_B2 | D1_B2 | ... | DL_B2 |
| TB6 | D0_B3 | D1_B3 | ... | DL_B3 |
| TC0 | D0_B4 | D1_B4 | ... | DL_B4 |
| TC1 | D0_B5 | D1_B5 | ... | DL_B5 |
| TC2 | D0_B6 | D1_B6 | ... | DL_B6 |
| TC3 | D0_B7 | D1_B7 | ... | DL_B7 |
| TC4 | Hsync | Hsync | ... | Hsync |
| TC5 | Vsync | Vsync | ... | Vsync |
| TC6 | DE | DE | ... | DE |
| TD0 | D0_R0 | D1_R0 | ... | DL_R0 |
| TD1 | D0_R1 | D1_R1 | ... | DL_R1 |
| TD2 | D0_G0 | D1_G0 | ... | DL_G0 |
| TD3 | D0_G1 | D1_G1 | ... | DL_G1 |
| TD4 | D0_B0 | D1_B0 | ... | DL_B0 |
| TD5 | D0_B1 | D1_B1 | ... | DL_B1 |
| TD6 | Empty | Empty | ... | Empty |

wherein TA0 . . . TA6, TB0 . . . TB6, TC0 . . . TC6; and TD0 . . . TD6, denote the 7 bits of first, second, third, and fourth LVDS data channels, respectively; D0_R0 . . . D0_R7 denote 8 respective bits of the red component of a first pixel; D0_G0 . . . D0_G7 denote 8 respective bits of the green component of the first pixel; D0_B0 . . . D0_B7 denote 8 respective bits of the blue component of the first pixel; D1_R0 . . . D1_R7 denote 8 respective bits of the red component of a second pixel; D1_Gob . . . D1_G7 denote 8 respective bits of the green component of the second pixel; D1_B0 . . . D1_B7 denote 8 respective bits of the blue component of the second pixel; DL_R0 . . . DL_R7 denote 8 respective bits of the red component of an L-th pixel; DL_G0 . . . DL_G7 denote 8 respective bits of the green component of the L-th pixel; and DL_B0 . . . DL_B7 denote 8 respective bits of the blue component of the L-th pixel. In the transmission format of Table 1, data of only one pixel is transmitted during each LVDS clock cycle.

In a LCD system having a resolution of 1280*720 pixels, and operating at a refresh frequency of about 75 Hz, the pixel data may be provided to the LVDS transmitter at a pixel data rate of approximately 75 MHz. Accordingly, a single LVDS stream, e.g., operating at a LVDS clock of 135 Mhz may be used. In a LCD system having a resolution of 1920*1080 pixels, and operating at a refresh frequency of about 60 Hz, the pixel data may be provided at a pixel data rate of approximately 148.5 MHz.

Accordingly, in such a system it may be required to implement two LVDS streams, each operating at a LVDS clock of 135 MHz.

SUMMARY OF SOME DEMONSTRATIVE EMBODIMENTS OF THE INVENTION

Some demonstrative embodiments of the invention include methods, devices and/or systems to transfer data over serial signals.

Some demonstrative embodiments of the invention include a method of transferring over serial signals data representing an image to be reproduced. The method may include, for example, generating a set of one or more data signals including image data received at an image data rate; and generating a transmission clock signal having a clock cycle during which the set of image data signals includes image data of more than one pixel of the image to be reproduced.

According to some demonstrative embodiments of the invention, the method may include transmitting the set of data signals over one or more serial transmission streams based on the transmission clock signal.

According to some demonstrative embodiments of the invention, the one or more serial transmission streams may include one or more low voltage differential signaling streams, e.g., including at least four low voltage differential signaling channels. The transmitting may include, for example, transmitting over one or more of the channels seven bits of the image data during the clock cycle of the transmission clock signal.

According to some demonstrative embodiments of the invention, the one or more serial transmission streams may include, for example, two or more serial transmission streams. The method may include, for example, transmitting the transmission clock signal over a number of serial channels, which is smaller than a number of the streams.

According to some demonstrative embodiments of the invention, the method may include buffering data corresponding to a predefined number of pixels of the image to be reproduced; and arranging the buffered data in a predefined arrangement based on one or more attributes of a serial transmission stream intended to transmit the image data. The predefined number of pixels may relate, for example, to the image data rate.

According to some demonstrative embodiments of the invention, the image data rate may be higher, for example, than a rate of the transmission clock signal.

According to some demonstrative embodiments of the invention, the image data may include image data in terms of at least three primary colors, for example, image data in terms of at least four primary colors, e.g., image data in terms of at least six primary colors.

According to some demonstrative embodiments of the invention, the image data may include image data having a bit depth of at least eight bits, e.g., image data having a bit depth of at least ten bits.

Some demonstrative embodiments of the invention may include a serial transmission scheme to transfer over serial signals data representing an image to be reproduced. The transmission scheme may include, for example, a formatter to generate a set of one or more data signals including image data received at an image data rate; and a transmission clock signal having a clock cycle during which the set of image data signals includes image data of more than one pixel of the image to be reproduced.

According to some demonstrative embodiments of the invention, the transmission scheme may include one or more serial transmitters to transmit the set of data signals over one or more serial transmission streams based on the transmission clock signal.

According to some demonstrative embodiments of the invention, the one or more serial transmitters may include one or more low voltage differential signaling transmitters to transmit the set of data signals over one or more low voltage differential signaling streams. One or more of the low voltage differential signaling streams may include, for example, at least four low voltage differential signaling channels.

According to some demonstrative embodiments of the invention, the formatter may include a buffer to buffer data corresponding to a predefined number of pixels of the image to be reproduced; and an arranger to arrange the buffered data in a predefined arrangement based on one or more attributes of a serial transmission stream intended to transmit the image data.

Some demonstrative embodiments of the invention may include a display system to reproduce a color image. The system may include, for example, a display to reproduce the image; a controller to control the display based on image data representing the image; and a serial transmission scheme, e.g., as described above, to transfer the image data to the controller over serial signals.

BRIEF DESCRIPTION OF THE DRAWINGS

The subject matter regarded as the invention is particularly pointed out and distinctly claimed in the concluding portion of the specification. The invention, however, both as to organization and method of operation, together with features and advantages thereof, may best be understood by reference to the following detailed description when read with the accompanied drawings in which:

Figure 1:
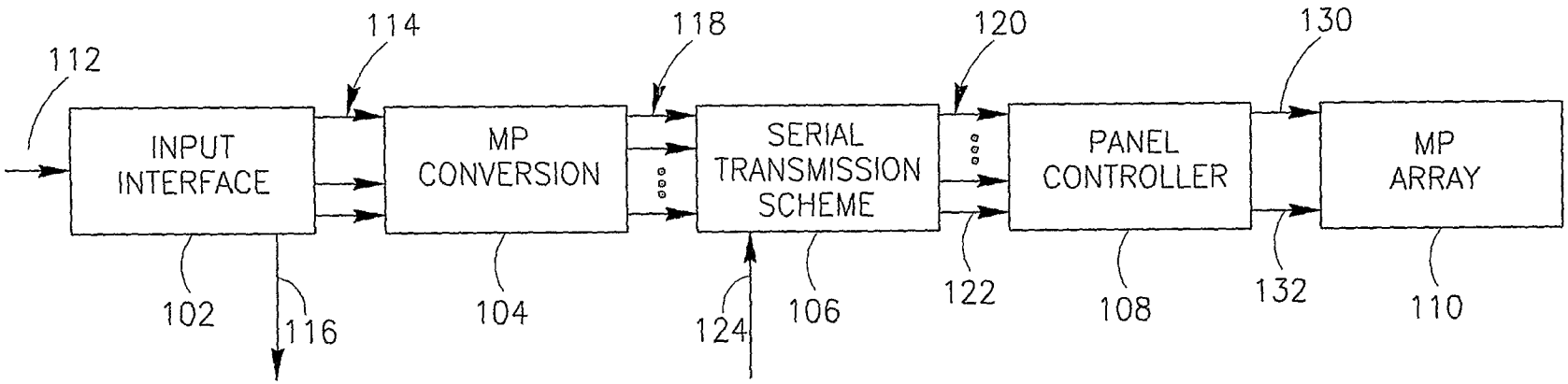
FIG. 1 is a schematic illustration of a liquid crystal display (LCD) system in accordance with some demonstrative embodiments of the invention.

It will be appreciated that for simplicity and clarity of illustration, elements shown in the figures have not necessarily been drawn accurately or to scale. For example, the dimensions of some of the elements may be exaggerated relative to other elements for clarity or several physical components included in one element. Further, where considered appropriate, reference numerals may be repeated among the figures to indicate corresponding or analogous elements. It will be appreciated that these figures present examples of embodiments of the present invention and are not intended to limit the scope of the invention.

DETAILED DESCRIPTION OF SOME EMBODIMENTS OF THE INVENTION

In the following detailed description, numerous specific details are set forth in order to provide a thorough understanding of the invention. However, it will be understood by those of ordinary skill in the art that the invention may be practiced without these specific details. In other instances, well-known methods, procedures, components, units and/or circuits have not been described in detail so as not to obscure the invention.

Unless specifically stated otherwise, as apparent from the following discussions, it is appreciated that throughout the specification discussions utilizing terms such as "processing", "computing", "calculating", "determining", or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices. In addition, the term "plurality" may be used throughout the specification to describe two or more components, devices, elements, parameters and the like.

Some embodiments of the invention may be implemented, for example, using a machine-readable medium or article which may store an instruction or a set of instructions that, if executed by a machine (for example, by a processor and/or by other suitable machines), cause the machine to perform a method and/or operations in accordance with embodiments of the invention. Such a machine may include, for example, any suitable processing platform, computing platform, computing device, processing device, computing system, processing system, computer, processor, or the like, and may be implemented using any suitable combination of hardware, firmware, and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, various types of Digital Versatile Disks (DVDs), a tape, a cassette, or the like. The instructions may include any suitable type of code, for example, source code, compiled code, interpreted code, executable code, static code, dynamic code, or the like, and may be implemented using any suitable high-level, low-level, object-oriented, visual, compiled and/or interpreted programming language, e.g., C, C++, Java, BASIC, Pascal, Fortran, Cobol, assembly language, machine code; and/or any suitable type of logic chip, array, or circuit, e.g., and Application Specific Integrated Circuit (ASIC), a Field Programmable Gate Array (FPGA), or the like.

Some demonstrative embodiments of the invention, may include a device, system and/or method of receiving image data at an image data rate, the image data including, for example, data of a plurality of pixels representing an image to be reproduced; and/or generating a transmission clock signal and a set of signals including the image data, wherein during a clock cycle, e.g., during each clock cycle, of the transmission clock signal, the set of signals includes data of more than one of the plurality of pixels, e.g., as described in detail below.

Some demonstrative embodiments of the invention, e.g., as are described herein, may relate to methods, devices and/or systems for transmitting Multi-Primary (MP) data over a serial transmission scheme, e.g., including one or more Low Voltage Differential Signaling (LVDS) streams. However, it will be appreciated by those skilled in the art that other embodiments of the invention may be implemented for transmitting any other desired data, e.g., any suitable video data, image data, and/or pixel data, over any suitable serial transmission scheme. For example, some embodiments of the invention may be implemented for transmitting over one or more LVDS streams, e.g., over two LVDS streams, three-primary data in an expanded bit representation, for example, a representation wherein each primary color component is represented by more or less than eight bits, e.g., 30-bit RGB data wherein each bit is represented by ten bits, or data wherein one or more bits are represented by six bits.

Embodiments of monitors and display systems with more than three primaries, in accordance with demonstrative embodiments of the invention, are described in International Application PCT/IL02/00452, filed Jun. 11, 2002, entitled "DEVICE, SYSTEM AND METHOD FOR COLOR DISPLAY" and published 19 Dec. 2002 as PCT Publication WO 02/101644 (Reference 1); and in International Application PCt/IL2005/000161, filed Feb. 9, 2005, entitled "METHOD DEVICE, AND SYSTEM OF DISPLAYING A MORE-THAN-THREE PRIMARY COLOR IMAGE". and published 18 Aug. 2005 as PCT Publication WO 2005/076257 (Reference 2), the entire disclosures of both of which are incorporated herein by reference.

Reference is now made to FIG. 1, which schematically illustrates a LCD system 100 in accordance with some demonstrative embodiments of the invention.

According to some demonstrative embodiments of the invention, system 100 may include an input interface 102 to receive an input signal 112, e.g., including a digital video input signal, and provide an output including a set of three-primary pixel data signals 114, and one or more video control signals 116. For example, input signal 112 may include a three-primary, e.g., RGB or YCC, video signal, having any suitable video format, e.g., a Digital Video Interface (DVI) format, as is known in the art. Three-primary pixel data signals 114 may include, for example three, parallel, primary color data signals, e.g., 8-bit or 10-bit signals, as are known in the art. Signals 114 may include, for example, pixel data of a plurality of pixels representing an image to be reproduced by system 100. Signals 114 may include, for example, a first signal including sub-pixel data of a first primary color, e.g., red; a second signal including sub-pixel data of a second primary color, e.g., green; and a third signal including sub-pixel data of a third primary color, e.g., blue, e.g., as is known in the art. Signals 116 may include any suitable timing and/or control signals, e.g., including a Data Enable (DE) signal, a horizontal synchronize (Hsync) signal, a vertical synchronize (Vsync) signal and/or a clock signal, as are known in the art. For example, input interface 102 may include or may be the PanelLink® receiver available from Silicon Image of California, USA, or any other suitable interface module.

According to some demonstrative embodiments of the invention, system 100 may also include a multi-primary converter 104 to convert the data of signals 114 into multi-primary sub-pixel data representing the image in terms of at least four primary colors. For example, converter 104 may convert pixel data signals 114 into a set of n-primary data signals 118, which may include, for example, a set of n, parallel, sub-pixel signals, each representing sub-pixel attenuation levels corresponding to one of the n primary colors on a desired bit-depth, e.g., 8-bit, 10-bit or any other suitable bit-depth, e.g., as described in references 1 and/or 2. Although the invention is not limited in this respect, converter 104 may also perform any suitable processing algorithm to process the n-primary data, e.g., as described in References 1 and/or 2.

According to some demonstrative embodiments of the invention, system 100 may also include a panel controller 108 to control a display array 110, and a serial transmission scheme 106 to transfer the data of signals 118 to panel controller 108, e.g., over one or more serial transmission streams. For example, serial transmission scheme 118 may provide panel controller 108 with a set of n-primary data signals 120 corresponding to signals 118; and an image data clock signal 122 corresponding to an image data clock signal 124, e.g., as described in detail below. Image data clock signal 124 may correspond to a data rate of the data of signals 118. For example, clock signal 124 may be based on one or more of signals 116, e.g., as described in references 1 and/or 2. Image data clock signal 124 may have a data clock rate of, for example, 148.5 MHz, e.g., if array 110 has a resolution of 1920*1080 pixels, and operates at a refresh frequency of about 60 Hz.

Although some demonstrative embodiments of the invention refer to a multi-primary LCD system, e.g., system 100, it will be appreciated by those of ordinary skill in the art, that other embodiments of the invention may refer to a three primary, e.g., RGB, LCD system. For example, in some embodiments system 100 may not include MP converter 104, and/or signals 114 may be provided to scheme 106.

According to demonstrative embodiments of the invention, array 110 may include an array of sub-pixel elements, e.g., Liquid Crystal (LC) elements (cells), for example, an LC array using Thin Film Transistor (TFT) active-matrix technology, as is known in the art. For example, each one of the LC cells may be connected to a horizontal ("row") line (not shown) and a vertical ("column") line (not shown), as are known in the art. Array 110 may be able to drive the LC cells, e.g., by active-matrix addressing, as is known in the art. In some demonstrative embodiments of the invention, array 110 may include a multi-primary sub-pixel array, for example, array 110 may also include an n-primary-color filter array, e.g., as described in References 1 and/or 2. In LCD devices according to some demonstrative embodiments of the invention, a full-color pixel of the displayed image may be reproduced by more than three sub-pixels, each sub-pixel corresponding to a different primary color, e.g., a pixel may be reproduced by driving a corresponding set of four or more sub-pixels.

For each of the four or more sub-pixel there may be a corresponding LC cell, and each LC cell may be associated with a color filter element in the color filter array corresponding to one of four or more, respective, primary colors, e.g., as described in References 1 and/or 2. A back-illumination source (not shown) may provide light needed to produce the color images. The transmittance of one or more of the sub-pixels may be controlled by controlling a voltage applied across a corresponding LC cell. Panel controller 108 may controllably activate the LC cells of array 110, e.g., using control signals 130 and/or data signals 132, for example, based on the image data of signals 120 and/or clock signal 122, e.g., as described in References 1 and/or 2. The intensity of white light provided by the back-illumination source may be spatially modulated by the LC cells, thereby selectively controlling the illumination of each sub-pixel according to image data for the sub-pixel. The selectively attenuated light of each sub-pixel may pass through the corresponding color filters of the LC cells, thereby producing desired color sub-pixel combinations. The human vision system may spatially integrate the light filtered through the different color sub-pixels to perceive a color image.

According to some demonstrative embodiments of the invention, signals 118 may include n, e.g., parallel, signals. Serial transmission scheme 106 may convert the parallel data into serial transmission signals, e.g., LVDS signals; transmit the serial transmission signals over one or more serial transmission streams, e.g., LVDS streams; and/or de-convert the serial transmission signals into parallel signals 120, e.g., as described in detail below. The implementation of scheme 106 for transferring the data of signals 118 to panel controller 108 may result in a relatively reduced level of Electro Magnetic Interference.

According to some demonstrative embodiments of the invention, it may be desired to transfer to panel controller 108 pixel data including more than 24 image data bits per pixel, e.g., corresponding to the n-primary data of signals 118. In one example, it may be desired to transfer 32, 40, or 48 image data bits per pixel, e.g., if signals 118 include data of four, five or six primary color components, respectively, wherein each primary color component is represented by an 8-bit value. In another example, it may be desired to transfer 40, 50, or 60 image data bits per pixel, e.g., if signals 118 include data of four, five or six primary color components, respectively, wherein each primary color component is represented by a 10-bit value. In yet another example, it may be desired to transfer 30 image data bits per pixel, e.g., if signals 118 include data of three primary colors, e.g., RGB data, wherein each primary color component is represented by a 10-bit value. In other examples, any other suitable data format, e.g., including there or more primary color components represented by any suitable bit depth. It will be appreciated by those skilled in the art that a single conventional LVDS stream including four or five data channels may support the transfer of only 28, or 35 data bits per clock cycle, respectively, e.g., including control and/or timing bits, e.g., 3 control/timing bits. In addition, the transmission clock rate, e.g., 135 MHz, of the LVDS stream may be smaller than the image data clock rate, e.g., 148.5 MHz. Thus, it may not be possible to efficiently transmit over the single conventional LVDS stream two or more sets, each including data of up to three primary colors.

According to a first demonstrative embodiment of the invention, serial transmission scheme 106 may be configured to enable transmission of signals 118, e.g., by using an LVDS stream including LVDS channels having an increased bandwidth, e.g., a bandwidth of about 1.05 Gbps, compared to conventional LVDS channels, e.g., to enable using the conventional LVDS clock rate of 135 MHz to transfer the data bits of signals 118, which may be received at a data clock rate of 148.5 MHz. However, such a configuration may require that the configuration of panel controller 108 be adapted to support the increased LVDS channel bandwidth.

According to a second demonstrative embodiment of the invention, serial transmission scheme 106 may be configured to include a number of LVDS streams, e.g., two streams, for example, adapted to transfer the image data of signals 118, e.g., without increasing the standard LVDS channel bandwidth. Scheme 106 may include, for example, two or four conventional LVDS streams, e.g., each including four channels having a bandwidth of 7 bits per LVDS clock cycle, to support signals 118, e.g., if signals 118 include 6-primary pixel data at an image data clock rate of 148.5 MHz. For example, four LVDS streams, each including four LVDS channels at a LVDS clock rate of 135 MHZ, may be implemented to transfer six primary color pixel data at an image data clock rate of 148.5 MHz. A smaller number of LVDS streams, e.g., three LVDS streams, may be required, if, for example, the data of signals 118 includes less than six, e.g., four or five, primary color components per pixel. It will be appreciated by those of ordinary skill in the art that this transmission scheme may be relatively easy to implement. However, such a transmission scheme may include an increased number of LVDS transmitters, and/or LVDS receivers, e.g., compared to a serial transmission scheme including a single LVDS stream.

According to a third demonstrative embodiment of the invention, the data of signals 118 may be converted into a LVDS format, e.g., different than the standard video LVDS format, for example, such that each LVDS channel transfers more than seven bits per LVDS clock signal. However, this may require changing the physical layer of the LVDS.

According to other demonstrative embodiments of the invention, serial transmission scheme 106 may be adapted to transfer the image data of signals 118 over one or more LVDS streams such that data corresponding to more than one pixel is transmitted per transmitter clock cycle, as described in detail below.

Figure 2:
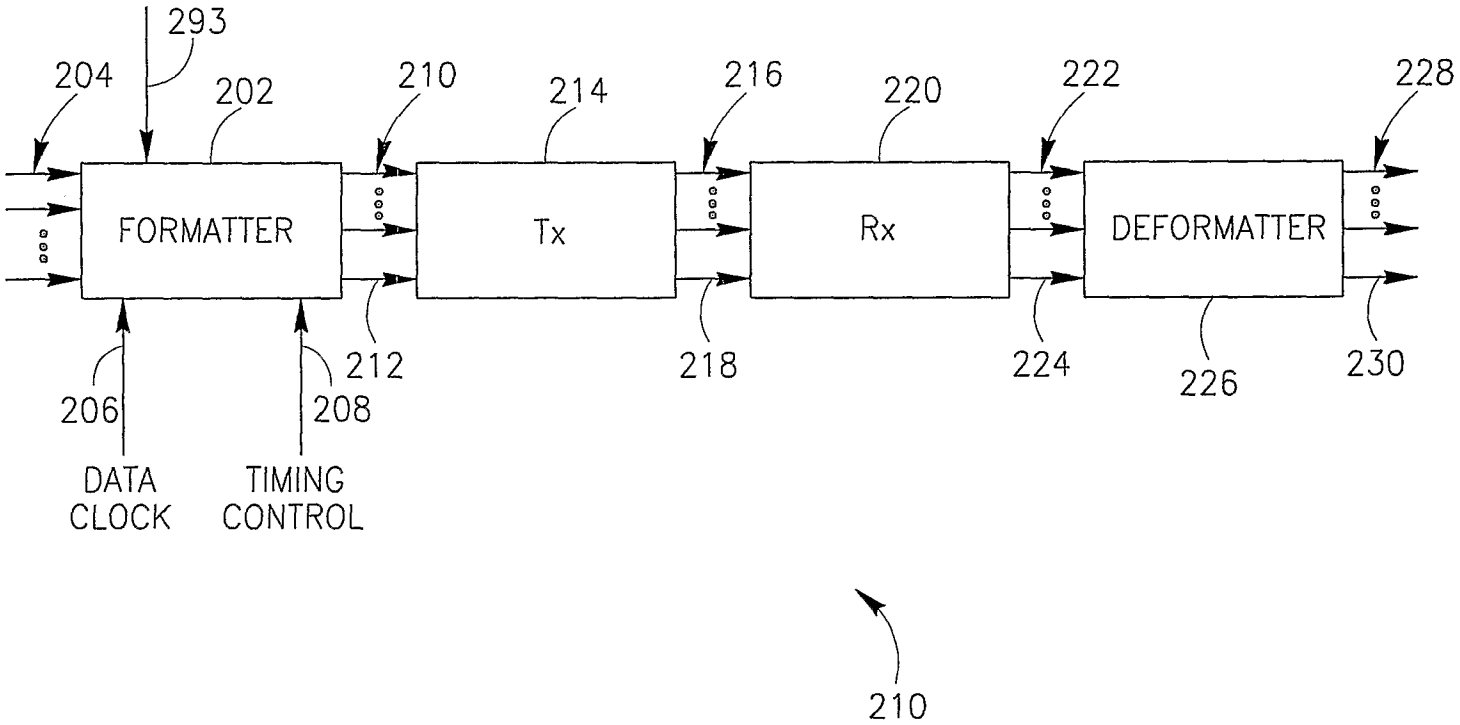
FIG. 2 is a schematic illustration of a serial transmission scheme in accordance with some demonstrative embodiments of the invention.

Reference is made to FIG. 2, which schematically illustrates a serial transmission scheme 200 in accordance with some demonstrative embodiments of the invention. Although the invention is not limited in this respect, serial transmission scheme 200 may perform the functionality of serial transmission scheme 106 (FIG. 1).

According to some demonstrative embodiments of the invention, transmission scheme 200 may include a formatter 202, one or more serial transmitters (Tx) 214, one or more serial receivers (Rx) 220, and/or a de-formatter 228, as are described in detail below.

According to some demonstrative embodiments of the invention, formatter 202 may receive a set of signals 204, which may include image data of an image to be reproduced, e.g., by array 110 (FIG. 1). Signals 204 may include, for example, a set of n, e.g., parallel, sub-pixel signals, representing sub-pixel attenuation levels on desired bit-depths, e.g., 8-bit, 10-bit or any other suitable bit-depth, as described in references 1 and/or 2. Although the invention is not limited in this respect, signals 204 may include, for example, signals 118 (FIG. 1). Formatter 202 may also receive an image data clock signal 206, and/or one or more timing and/or control signals 208. Image data clock signal 206 may represent, for example, a data rate of signals 204, e.g., as is known in the art. For example, image data clock signal 206 may have a clock rate of 148.5 MHz. Although the invention is not limited in this respect, image data clock signal 206 may include, for example, clock signal 124 (FIG. 1). Timing and/or control signals 208 may include any suitable timing and/or control signals, e.g., including a DE signal, a Hsync signal, and/or a Vsync signal, as are all known in the art. Although the invention is not limited in this respect, signals 206 and/or 208 may be based on signals 116 (FIG. 1).

According to some demonstrative embodiments of the invention, formatter 202 may generate one or more sets of image data signals 210 to be provided to one or more serial transmitters 214, respectively. Image data signals 210 may include, for example, a plurality of parallel signals including a sequence of bits corresponding to the bits of signals 204. For example, each set of signals 210 may include a plurality of signals corresponding to a plurality of bits to be transmitted by a respective one of transmitters 214, e.g., as described below. Formatter 202 may also provide serial transmitters 214 with a transmitter clock signal 212, for example, a LVDS clock signal, e.g., having a clock frequency of 135 MHz. Each set of signals 210 may include, for example, 28 or 35 parallel signals, e.g., if transmitter 214 includes four or five channels, respectively, each adapted to transmit seven bits per clock cycle of signal 212.

According to some demonstrative embodiments of the invention, each one of serial transmitters 214 may transfer to a respective one of serial receivers 220, the bits of a respective one of signal sets 210 over a respective serial transmission stream, e.g., a LVDS stream including one or more, e.g., four or five, serial data transmission channels 216. Serial transmitters 214 may also transfer clock signal 212 over a clock channel 218. Although the invention is not limited in this respect, in some demonstrative embodiments a single clock channel 218 may be implemented for two or more serial transmission streams, e.g., for all LVDS streams. Based on the data bits received over channels 216, and/or the clock received over channel 218, one or more receivers 220 may generate one or more respective serial signal sets 222, and/or reconstruct a clock signal 224, e.g., using any suitable method or algorithm as are known in the art.

According to some demonstrative embodiments of the invention, de-formatter 226 may de-format the bits of signals 222 into a set of, e.g., parallel, signals 228, e.g., such that signals 228 are formatted in accordance with the format of signals 204. De-formatter 226 may perform on signals 222, for example, an inverse of an operation performed on signals 204 by formatter 202. It will be appreciated by those of ordinary skill in the art that the operation and/or configuration of de-formatter 226 may be easily determined, for example, based on the configuration and/or operation of formatter 202. For example, signals 204 and/or 228 may include data formatted according to a Complementary-Metal-Oxide-Semiconductor/Transistor-Transistor-Logic (CMOS/TTL) format, e.g., as is known in the art.

Although the invention is not limited in this respect, serial transmitters 214 may include one or more LVDS transmitters, channels 216 may include LVDS data channels, channel 218 may include a LVDS clock channel, and/or receivers 220 may include one or more LVDS receivers, e.g., as are all well known in the art. Accordingly, each LVDS transmitter may transfer to a respective LVDS receiver the bits of a respective signal set of signals 210, for example, over four or five LVDS data channels 216.

According to some demonstrative embodiments of the invention, formatter 202 may format or "pack" the image data of signals 204, such that signals 210 may be transferred over one or more serial streams including, for example, one or more standard serial, e.g., LVDS streams, as described in detail below. For example, one or more sets of signals 210 generated by formatter 202 may include a plurality of parallel signals, e.g., 28 signals, such that during a clock cycle of signal 212 signals 210 include image data of more than one pixel, as described below.

According to some demonstrative embodiments of the invention, signals 204 may include data of, e.g., six primary colors, at a bit depth of, e.g., 8 bits; and/or data clock 206 may have a clock frequency of, e.g., 148.5 MHz. Channels 216 and 218 may be implemented, for example, by two LVDS streams, each including, for example, five LVDS channels. The LVDS streams may implement a LVDS clock rate, e.g., a standard LVDS clock rate of 135 Mhz. Accordingly, formatter 202 may be adapted to generate two signal sets 210 including the data of signals 204, e.g., each set including 28 parallel signals; and signal 212, e.g., having a clock rate of 135 MHz. Formatter 202 may format signals 210, e.g., such that during a clock cycle of clock signal 212, e.g., during each clock cycle, signals 210 include image data of more than one pixel, as described in detail below.

It will be appreciated that a standard LVDS stream may have five channels, one of which may typically be used as a clock channel. Each channel may be adapted for example, to transfer seven bits per LVDS clock cycle. According to some demonstrative embodiments of the invention, a single clock channel may be implemented, e.g., when using two or more LVDS streams. Accordingly, when implementing two LVDS streams, nine LVDS channels, e.g., channels 216, may be used for transferring data and a tenth channel, e.g., channel 218, may be used for transferring the LVDS clock. This may enable transferring 9*7=63 data bits per clock cycle of clock 212. One or more of the 63 bits, e.g., 3 bits, may be used to transfer control and/or timing data bits, e.g., corresponding to signals 208. As a result, up to 60 data bits may be transferred per clock cycle of clock 212, e.g., if two LVDS streams are implemented.

According to some demonstrative embodiments of the invention, the two LVDS streams described above may enable a LVDS transmission rate of 135 MHz*60 bits=8.1 Gbps. The image data of signals 204 may be received, for example, at an image data clock rate of 148.5 MHZ, e.g., if each pixel is represented by 48 bits corresponding to six primary color components, each of which having a bit depth of eight bits. Thus, the image data rate of signals 204 may be, for example, 148.5 MHz*48 bits=7.128 Gbps. Accordingly, it will be appreciated that the LVDS transmission rate of the two LVDS streams may enable transmission of the pixel data of signals 204.

According to some demonstrative embodiments of the invention, formatter 202 may generate signals 210 including data bits representing more than one pixel of image data 204, per cycle of clock 212, e.g., per each cycle of clock 212. For example, formatter 202 may buffer image data of signals 204 corresponding to more than one pixel, e.g., as described in detail below with reference to FIG. 4.

According to some demonstrative embodiments of the invention, formatter 202 may distribute the bits of signals 204 at sub-pixel level, for example, by distributing bits representing a primary color sub-pixel as a group, e.g., by collectively distributing all 8 bits of each primary color. In these embodiments formatter 202 may generate, per clock cycle of clock 212, signals 210 including, for example, 56 data bits, e.g., corresponding to seven 8-bit sub-pixels. Thus, formatter 202 may be adapted to transfer data bits of 35 8-bit sub-pixels, during five clock cycles of clock signal 212. If image data clock 216 has a clock rate of 148.5 MHz and signals 204 include five-primary color data at a bit depth of 8-bits, then it may be required that LVDS clock signal 212 may have a clock rate of at least 148.5*5/7~106 MHz, which is smaller than the LVDS standard clock rate of 135 MHz. In another example, formatter 202 may be adapted to transfer data bits of 42 8-bit sub-pixels, during six clock cycles of clock signal 212. Accordingly, if image data clock 216 has a clock rate of 148.5 MHz and signals 204 include six-primary color data at a bit depth of 8-bits, then it may be required that LVDS clock signal 212 may have a clock rate of at least 148.5*6/7~127 MHz, which is smaller than the LVDS standard clock rate of 135 MHz.

According to some demonstrative embodiments, formatter 202 may format the image data of signals 204 "at the bit level" of signals 204, e.g., without taking into account the sub-pixels represented by the bits of signals 204. Accordingly, per each LVDS clock cycle, 60 bits of data may be transferred over channels 216. Thus, in one example, signals 212 may include bits representing 60/40=1.5 pixels per clock cycle of clock 212, e.g., if signals 204 include five-primary color data at a bit-depth of 8 bits. Accordingly, formatter 202 may be adapted to transfer bits of 1.5*2=3 five-primary pixels during two clock cycles of clock 212. As a result, if image data clock 216 has a clock rate of 148.5 MHz, then it may be required that LVDS clock signal 212 may have a clock rate of at least 148.5*2/3~99 MHz LVDS, which is smaller than the LVDS standard clock rate of 135 MHz. In another example, signals 212 may include bits representing 60/48=1.2 pixels per clock cycle of signal 212, e.g., if signals 204 include six-primary color data at a bit-depth of 8 bits. Accordingly, formatter 202 may be adapted to transfer bits of 1.2*5=6 six-primary pixels during five clock cycles of clock 212, e.g., as described below with reference to FIG. 3. As a result, if image data clock 216 has a clock rate of 148.5 MHz, then it may be required that LVDS clock signal 212 may have a clock rate of at least 148.5*5/6~124 MHz LVDS, which is smaller than the LVDS standard clock rate of 135 MHz.

Although the invention is not limited in this respect, according to some demonstrative embodiments of the invention, if channels 216 include channels of two LVDS streams, e.g., as described with reference to FIG. 3, formatter 202 may generate signals 210, for example, such that data bits of seven sub-pixels are transferred per clock cycle of clock 212. For example, a first LVDS stream may be implemented for transferring, per clock cycle of clock 212, data bits of three sub-pixels and control and timing bits; and a second LVDS stream may be implemented for transferring data bits of four sub-pixels per clock cycle of clock 212.

According to some demonstrative embodiments of the invention, formatter 202 may generate signals 210, and/or 212 based on one or more control signals 293 which may correspond, for example, to the rate of clock 206, the rate of a transmission clock 212, and/or the format of signals 204. For example, control signals 293 may control formatter 202 to generate signals 210 including bits arranged in accordance with a bit-depth of one or more of signals 204, and/or the number of primary colors represented by signals 204. Although the invention is not limited in this respect, control signals 233 may include, for example, signals representing one or more bit-depth values of one or more primary color components of signals 204. Formatter 202 may generate signals 210 including a first arrangement of data bits if control signals 293 represent, for example, a first bit-depth, e.g., 6 bits; and/or a second arrangement of data bits if control signals 293 represent, for example, a second bit-depth, e.g., 12 bits.

According to some demonstrative embodiments of the invention, the data bits of signals 204 may be arranged in signals 210 by formatter 202 according to any suitable, method algorithm, scheme and/or arrangement, e.g., as are described herein. De-formatter 226 may be adapted to arrange the data bits of signals 222 in signals 228, e.g., based on a method, algorithm, scheme or arrangement corresponding to the method, algorithm, scheme or arrangement implemented by formatter 202, e.g., such that de-formatter 226 performs an inverse of an operation performed by formatter 202.

Aspects of the invention are described herein in the context of demonstrative embodiments of a formatter, e.g., formatter 202, one or more serial transmitters, e.g., transmitters 214, one or more serial receivers, e.g., receivers 220, and a de-formatter, e.g., de-formatter 226, being separate units of a serial transmission scheme, e.g., serial transmission scheme 200. However, it will be appreciated by those skilled in the art that, according to other embodiments of the invention, the formatter, the one or more serial transmitters, the one or more serial receivers, and/or the de-formatter may be implemented in any other suitable configuration and/or arrangement. For example, formatter 202 and/or transmitters 214 may be implemented as part of converter 104 (FIG. 1); and/or de-formatter 226 and/or receivers 220 may be implemented as part of controller 108 (FIG. 1).

Figure 3:
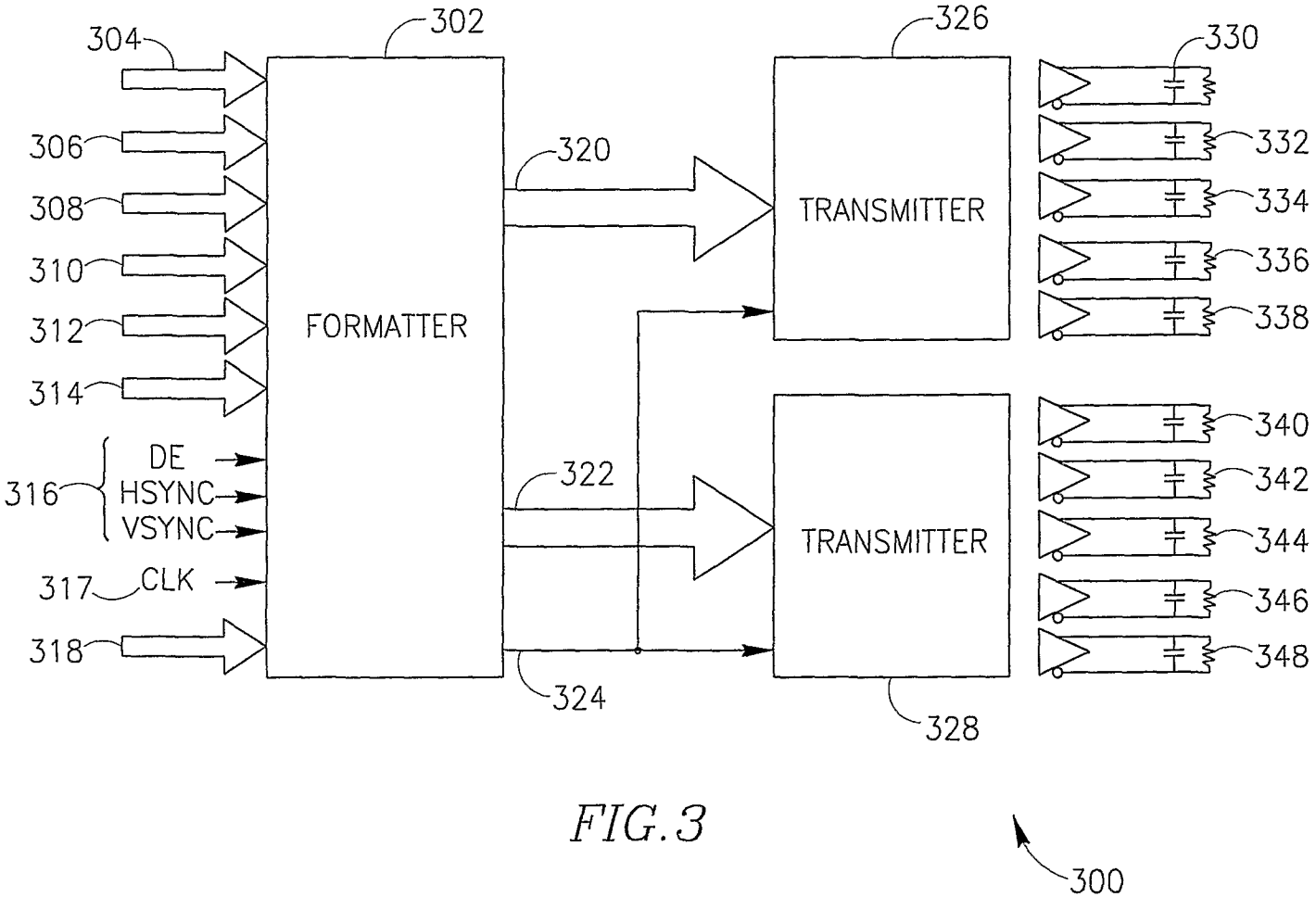
FIG. 3 is a schematic illustration of a serial transmitting arrangement in accordance with some demonstrative embodiments of the invention.

Reference is now made to FIG. 3, which schematically illustrates a transmitting arrangement 300 in accordance with some demonstrative embodiments of the invention.

According to some demonstrative embodiments of the invention, arrangement 300 may include a formatter 302 and two LVDS transmitters, 326 and 328, respectively. Although the invention is not limited in this respect, formatter 302 may perform the functionality of formatter 202 (FIG. 2), and/or transmitters 326 and 328 may perform the functionality of transmitters 214 (FIG. 2).

According to some demonstrative embodiments of the invention, formatter 302 may receive image data signals 301, for example, including six 8-bit signals 304, 306, 308, 310, 312, and 316 including first, second, third, fourth, fifth and sixth primary color components, respectively; one or more timing and/or control signals 314, e.g., including Hsync, Vsync, and/or DE signals; an image data clock signal 317; and/or one or more control signals 318. Image data clock 317 may have a clock rate of, for example, 148.5 MHz.

Although the invention is not limited in this respect, in some demonstrative embodiments of the invention, the image data of signals 301 corresponding to first, second, third, fourth, fifth, and sixth consecutive pixels may be arranged, for example, as follows, e.g., such that signals 301 include 48 bits per clock cycle of image data clock 317:

TABLE 2

| Data clock 1 | Data clock 2 | Data clock 3 | Data clock 4 | Data clock 5 | Data clock 6 |
|---|---|---|---|---|---|
| D0_P1_0 | D1_P1_0 | D2_P1_0 | D3_P1_0 | D4_P1_0 | D5_P1_0 |
| D0_P1_1 | D1_P1_1 | D2_P1_1 | D3_P1_1 | D4_P1_1 | D5_P1_1 |
| D0_P1_2 | D1_P1_2 | D2_P1_2 | D3_P1_2 | D4_P1_2 | D5_P1_2 |
| D0_P1_3 | D1_P1_3 | D2_P1_3 | D3_P1_3 | D4_P1_3 | D5_P1_3 |
| D0_P1_4 | D1_P1_4 | D2_P1_4 | D3_P1_4 | D4_P1_4 | D5_P1_4 |
| D0_P1_5 | D1_P1_5 | D2_P1_5 | D3_P1_5 | D4_P1_5 | D5_P1_5 |
| D0_P1_6 | D1_P1_6 | D2_P1_6 | D3_P1_6 | D4_P1_6 | D5_P1_6 |
| D0_P1_7 | D1_P1_7 | D2_P1_7 | D3_P1_7 | D4_P1_7 | D5_P1_7 |
| D0_P2_0 | D1_P2_0 | D2_P2_0 | D3_P2_0 | D4_P2_0 | D5_P2_0 |
| D0_P2_1 | D1_P2_1 | D2_P2_1 | D3_P2_1 | D4_P2_1 | D5_P2_1 |
| D0_P2_2 | D1_P2_2 | D2_P2_2 | D3_P2_2 | D4_P2_2 | D5_P2_2 |
| D0_P2_3 | D1_P2_3 | D2_P2_3 | D3_P2_3 | D4_P2_3 | D5_P2_3 |
| D0_P2_4 | D1_P2_4 | D2_P2_4 | D3_P2_4 | D4_P2_4 | D5_P2_4 |
| D0_P2_5 | D1_P2_5 | D2_P2_5 | D3_P2_5 | D4_P2_5 | D5_P2_5 |
| D0_P2_6 | D1_P2_6 | D2_P2_6 | D3_P2_6 | D4_P2_6 | D5_P2_6 |
| D0_P2_7 | D1_P2_7 | D2_P2_7 | D3_P2_7 | D4_P2_7 | D5_P2_7 |
| D0_P3_0 | D1_P3_0 | D2_P3_0 | D3_P3_0 | D4_P3_0 | D5_P3_0 |
| D0_P3_1 | D1_P3_1 | D2_P3_1 | D3_P3_1 | D4_P3_1 | D5_P3_1 |
| D0_P3_2 | D1_P3_2 | D2_P3_2 | D3_P3_2 | D4_P3_2 | D5_P3_2 |
| D0_P3_3 | D1_P3_3 | D2_P3_3 | D3_P3_3 | D4_P3_3 | D5_P3_3 |
| D0_P3_4 | D1_P3_4 | D2_P3_4 | D3_P3_4 | D4_P3_4 | D5_P3_4 |
| D0_P3_5 | D1_P3_5 | D2_P3_5 | D3_P3_5 | D4_P3_5 | D5_P3_5 |
| D0_P3_6 | D1_P3_6 | D2_P3_6 | D3_P3_6 | D4_P3_6 | D5_P3_6 |
| D0_P3_7 | D1_P3_7 | D2_P3_7 | D3_P3_7 | D4_P3_7 | D5_P3_7 |
| D0_P4_0 | D1_P4_0 | D2_P4_0 | D3_P4_0 | D4_P4_0 | D5_P4_0 |
| D0_P4_1 | D1_P4_1 | D2_P4_1 | D3_P4_1 | D4_P4_1 | D5_P4_1 |
| D0_P4_2 | D1_P4_2 | D2_P4_2 | D3_P4_2 | D4_P4_2 | D5_P4_2 |
| D0_P4_3 | D1_P4_3 | D2_P4_3 | D3_P4_3 | D4_P4_3 | D5_P4_3 |
| D0_P4_4 | D1_P4_4 | D2_P4_4 | D3_P4_4 | D4_P4_4 | D5_P4_4 |
| D0_P4_5 | D1_P4_5 | D2_P4_5 | D3_P4_5 | D4_P4_5 | D5_P4_5 |
| D0_P4_6 | D1_P4_6 | D2_P4_6 | D3_P4_6 | D4_P4_6 | D5_P4_6 |
| D0_P4_7 | D1_P4_7 | D2_P4_7 | D3_P4_7 | D4_P4_7 | D5_P4_7 |
| D0_P5_0 | D1_P5_0 | D2_P5_0 | D3_P5_0 | D4_P5_0 | D5_P5_0 |
| D0_P5_1 | D1_P5_1 | D2_P5_1 | D3_P5_1 | D4_P5_1 | D5_P5_1 |
| D0_P5_2 | D1_P5_2 | D2_P5_2 | D3_P5_2 | D4_P5_2 | D5_P5_2 |
| D0_P5_3 | D1_P5_3 | D2_P5_3 | D3_P5_3 | D4_P5_3 | D5_P5_3 |
| D0_P5_4 | D1_P5_4 | D2_P5_4 | D3_P5_4 | D4_P5_4 | D5_P5_4 |
| D0_P5_5 | D1_P5_5 | D2_P5_5 | D3_P5_5 | D4_P5_5 | D5_P5_5 |
| D0_P5_6 | D1_P5_6 | D2_P5_6 | D3_P5_6 | D4_P5_6 | D5_P5_6 |
| D0_P5_7 | D1_P5_7 | D2_P5_7 | D3_P5_7 | D4_P5_7 | D5_P5_7 |
| D0_P6_0 | D1_P6_0 | D2_P6_0 | D3_P6_0 | D4_P6_0 | D5_P6_0 |
| D0_P6_1 | D1_P6_1 | D2_P6_1 | D3_P6_1 | D4_P6_1 | D5_P6_1 |

TABLE 2-continued

| Data clock 1 | Data clock 2 | Data clock 3 | Data clock 4 | Data clock 5 | Data clock 6 |
|---|---|---|---|---|---|
| D0_P6_2 | D1_P6_2 | D2_P6_2 | D3_P6_2 | D4_P6_2 | D5_P6_2 |
| D0_P6_3 | D1_P6_3 | D2_P6_3 | D3_P6_3 | D4_P6_3 | D5_P6_3 |
| D0_P6_4 | D1_P6_4 | D2_P6_4 | D3_P6_4 | D4_P6_4 | D5_P6_4 |
| D0_P6_5 | D1_P6_5 | D2_P6_5 | D3_P6_5 | D4_P6_5 | D5_P6_5 |
| D0_P6_6 | D1_P6_6 | D2_P6_6 | D3_P6_6 | D4_P6_6 | D5_P6_6 |
| D0_P6_7 | D1_P6_7 | D2_P6_7 | D3_P6_7 | D4_P6_7 | D5_P6_7 |

wherein D0_P1__1 . . . D0_P1__8, D0_P2__1 . . . D0_P2__8, D0_P3__1 . . . D0_P3__8, D0_P4__1 . . . D0_P4__8, D0_P5__1 . . . D0_P5__8, and D0_P6__1 . . . D0_P6__8, denote 8 respective bits of first, second, third, fourth, fifth and sixth primary color components of the first pixel, respectively; D1_P1__1 . . . D1_P1__8, D1_P2__1 . . . D1_P2__8, D1_P3__1 . . . D1_P3__8, D1_P4__1 . . . D1_P4__8, D1_P5__1 . . . D1_P5__8, and D1_P6__1 . . . D1_P6__8, denote 8 respective bits of first, second, third, fourth, fifth and sixth primary color components of the second pixel, respectively; D2_P1__1 . . . D2_P1__8, D2_P2__1 . . . D2_P2__8, D2_P3__1 . . . D2_P3__8, D2_P4__1 . . . D2_P4__8, D2_P5__1 . . . D2_P5__8, and D2_P6__1 . . . D2_P6__8, denote 8 respective bits of first, second, third, fourth, fifth and sixth primary color components of the third pixel, respectively; D3_P1__1 . . . D3_P1__8, D3_P2__1 . . . D3_P2__8, D3_P3__1 . . . D3_P3__8, D3_P4__1 . . . D3_P4__8, D3_P5__1 . . . D3_P5__8, and D3_P6__1 . . . D3_P6__8, denote 8 respective bits of first, second, third, fourth, fifth and sixth primary color components of the fourth pixel, respectively; D4_P1__1 . . . D4_P1__8, D4_P2__1 . . . D4_P2__8, D4_P3__1 . . . D4_P3__8, D4_P4__1 . . . D4_P4__8, D4_P5__1 . . . D4_P5__8, and D4_P6__1 . . . D4_P6__8, denote 8 respective bits of first, second, third, fourth, fifth and sixth primary color components of the fifth pixel, respectively; and D5_P1__1 . . . D5_P1__8, D5_P2__1 . . . D5_P2__8, D5_P3__1 . . . D5_P3__8, D5_P4__1 . . . D5_P4__8, D5_P5__1 . . . D5_P5__8, and D5_P6__1 . . . D5_P6__8, denote 8 respective bits of first, second, third, fourth, fifth and sixth primary color components of the sixth pixel, respectively. Any other suitable arrangement of the bit values may be implemented. According to some demonstrative embodiments of the invention, formatter 302 may generate a first set of data signals 320 to be provided to LVDS transmitter 326; and/or a second set of data signals 322 to be provided to LVDS transmitter 328. Formatter 302 may also generate a LVDS clock signal 324 to be provided to transmitters 326 and/or 328.

According to some demonstrative embodiments of the invention, LVDS transmitters 326 and/or 328 may include LVDS transmitters, e.g., standard video LVDS transmitters, to transmit over standard LVDS streams. For example, transmitters 326 and/or 328 may include LVDS transmitter model No. DS90C365A available form National Semiconductor Corporation, e.g., as described at the Internet site <http://www.national.com/pf/DS/DS90C365A.html>; and/or LVDS chipset model No. THC63LVD103/104A available from THine Electronics Inc., e.g., as described at the internet site <http://www.thine.co.jp/products_e/LVDS/103__104/103__104.html>. Although the invention is not limited in this respect, LVDS transmitter 326 may transmit data bits of signals 320 over four LCDS data channels 330, 332, 334, and 336; and clock signal 324 over a LVDS clock channel 338. LVDS transmitter 328 may transmit data bits of signals 322 over four LCDS data channels 340, 342, 344, and 346; and clock signal 324 over a LVDS clock channel 348. Each one of channels 330, 332, 334, 336, 340, 342, 344, and/or 346 may be adapted to transfer 7 bits per clock cycle of clock 324. Accordingly, per clock cycle of signal 324, formatter 302 may generate signals 320, e.g., including 28 bits of the image data of signals 301, and/or signals 322, e.g., including 28 bits of the image data of signals 301, and/or control and/or timing bits of timing signals 316.

According to some demonstrative embodiments of the invention, formatter 302 may distribute the data bits of signals 301, and/or the control and/or timing bits of signals 316 according to a format suitable for transmission by transmitters 326 and/or 328. For example, per clock cycle of clock 324, formatter may distribute to each of one of signals 320 and 322 up to 35 bits, e.g., if all five channels of the LVDS streams are used for transferring data; or up to 28 bits, e.g., if only four channels are used for transferring data. Although the invention is not limited in this respect, formatter 302 may distribute the data bits of signals 301, and/or the control and/or timing bits of signals 316 based on control signals 318. Control signals 318 may include, for example, control signals 293 (FIG. 2).

Although the invention is not limited in this respect, signal 320 may include, for example, the following bit arrangement during six consecutive clock cycles of LVDS clock 324:

TABLE 3

| TX bit | LVDS clock 1 | LVDS clock 2 | LVDS clock 3 | LVDS clock 4 | LVDS clock 5 | LVDS clock 6 |
|---|---|---|---|---|---|---|
| TA0 | D0_P1_2 | D1_P1_7 | D2_P3_2 | D3_P4_3 | D4_P5_4 | D5_P6_5 |
| TA1 | D0_P1_3 | D1_P2_2 | D2_P3_3 | D3_P4_4 | D4_P5_5 | D5_P6_6 |
| TA2 | D0_P1_4 | D1_P2_3 | D2_P3_4 | D3_P4_5 | D4_P5_6 | D5_P6_7 |
| TA3 | D0_P1_5 | D1_P2_4 | D2_P3_5 | D3_P4_6 | D4_P5_7 | D5_P1_0 |
| TA4 | D0_P1_6 | D1_P2_5 | D2_P3_6 | D3_P4_7 | D4_P6_2 | D5_P1_1 |
| TA5 | D0_P1_7 | D1_P2_6 | D2_P3_7 | D3_P5_2 | D4_P6_3 | D5_P2_0 |
| TA6 | D0_P2_2 | D1_P2_7 | D2_P4_2 | D3_P5_3 | D4_P6_4 | D5_P2_1 |
| TB0 | D0_P2_3 | D1_P3_2 | D2_P4_3 | D3_P5_4 | D4_P6_5 | D5_P2_0 |
| TB1 | D0_P2_4 | D1_P3_3 | D2_P4_4 | D3_P5_5 | D4_P6_6 | D5_P2_1 |
| TB2 | D0_P2_5 | D1_P3_4 | D2_P4_5 | D3_P5_6 | D4_P6_7 | D5_P4_0 |
| TB3 | D0_P2_6 | D1_P3_5 | D2_P4_6 | D3_P5_7 | D4_P1_0 | D5_P4_1 |
| TB4 | D0_P2_7 | D1_P3_6 | D2_P4_7 | D3_P6_2 | D4_P1_1 | D5_P5_0 |
| TB5 | D0_P3_2 | D1_P3_7 | D2_P5_2 | D3_P6_3 | D4_P2_0 | D5_P5_1 |
| TB6 | D0_P3_3 | D1_P4_2 | D2_P5_3 | D3_P6_4 | D4_P2_1 | D5_P6_0 |
| TC0 | D0_P3_4 | D1_P4_3 | D2_P5_4 | D3_P6_5 | D4_P2_0 | D5_P6_1 |
| TC1 | D0_P3_5 | D1_P4_4 | D2_P5_5 | D3_P6_6 | D4_P2_1 | D6_P1_2 |
| TC2 | D0_P3_6 | D1_P4_5 | D2_P5_6 | D3_P6_7 | D4_P4_0 | D6_P1_3 |
| TC3 | D0_P3_7 | D1_P4_6 | D2_P5_7 | D3_P1_0 | D4_P4_1 | D6_P1_4 |
| TC4 | D0_P4_2 | D1_P4_7 | D2_P6_2 | D3_P1_1 | D4_P5_0 | D6_P1_5 |
| TC5 | D0_P4_3 | D1_P5_2 | D2_P6_3 | D3_P2_0 | D4_P5_1 | D6_P1_6 |
| TC6 | D0_P4_4 | D1_P5_3 | D2_P6_4 | D3_P2_1 | D4_P6_0 | D6_P1_7 |
| TD0 | D0_P4_5 | D1_P5_4 | D2_P6_5 | D3_P2_0 | D4_P6_1 | D6_P2_2 |
| TD1 | D0_P4_6 | D1_P5_5 | D2_P6_6 | D3_P2_1 | D5_P1_2 | D6_P2_3 |
| TD2 | D0_P4_7 | D1_P5_6 | D2_P6_7 | D3_P4_0 | D5_P1_3 | D6_P2_4 |
| TD3 | D0_P5_2 | D1_P5_7 | D2_P1_0 | D3_P4_1 | D5_P1_4 | D6_P2_5 |
| TD4 | D0_P5_3 | D1_P6_2 | D2_P1_1 | D3_P5_0 | D5_P1_5 | D6_P2_6 |
| TD5 | D0_P5_4 | D1_P6_3 | D2_P2_0 | D3_P5_1 | D5_P1_6 | D6_P2_7 |
| TD6 | D0_P5_5 | D1_P6_4 | D2_P2_1 | D3_P6_0 | D5_P1_7 | D6_P3_2 |

wherein TA0 . . . TA6, TB0 . . . TB6, TC0 . . . TC6, and TD0 . . . TD6, denote the 7 bits to be provided to LVDS data channels 330, 332, 334 and 336, respectively.

Although the invention is not limited in this respect, signal 322 may include, for example, the following bit arrangement during six consecutive clock cycles of LVDS clock 324:

TABLE 4

| TX bit | LVDS clock 1 | LVDS clock 2 | LVDS clock 3 | LVDS clock 4 | LVDS clock 5 | LVDS clock 6 |
|---|---|---|---|---|---|---|
| TE0 | D0_P5_6 | D1_P6_5 | D2_P2_0 | D3_P6_1 | D5_P2_2 | D6_P3_3 |
| TE1 | D0_P5_7 | D1_P6_6 | D2_P2_1 | D4_P1_2 | D5_P2_3 | D6_P3_4 |
| TE2 | D0_P6_2 | D1_P6_7 | D2_P4_0 | D4_P1_3 | D5_P2_4 | D6_P3_5 |
| TE3 | D0_P6_3 | D1_P1_0 | D2_P4_1 | D4_P1_4 | D5_P2_5 | D6_P3_6 |
| TE4 | D0_P6_4 | D1_P1_1 | D2_P5_0 | D4_P1_5 | D5_P2_6 | D6_P3_7 |
| TE5 | D0_P6_5 | D1_P2_0 | D2_P5_1 | D4_P1_6 | D5_P2_7 | D6_P4_2 |
| TE6 | D0_P6_6 | D1_P2_1 | D2_P6_0 | D4_P1_7 | D5_P3_2 | D6_P4_3 |
| TF0 | D0_P6_7 | D1_P2_0 | D2_P6_1 | D4_P2_2 | D5_P3_3 | D6_P4_4 |
| TF1 | D0_P1_0 | D1_P2_1 | D3_P1_2 | D4_P2_3 | D5_P3_4 | D6_P4_5 |
| TF2 | D0_P1_1 | D1_P4_0 | D3_P1_3 | D4_P2_4 | D5_P3_5 | D6_P4_6 |
| TF3 | D0_P2_0 | D1_P4_1 | D3_P1_4 | D4_P2_5 | D5_P3_6 | D6_P4_7 |
| TF4 | D0_P2_1 | D1_P5_0 | D3_P1_5 | D4_P2_6 | D5_P3_7 | D6_P5_2 |
| TF5 | D0_P2_0 | D1_P5_1 | D3_P1_6 | D4_P2_7 | D5_P4_2 | D6_P5_3 |
| TF6 | D0_P2_1 | D1_P6_0 | D3_P1_7 | D4_P3_2 | D5_P4_3 | D6_P5_4 |
| TG0 | D0_P4_0 | D1_P6_1 | D3_P2_2 | D4_P3_3 | D5_P4_4 | D6_P5_5 |
| TG1 | D0_P4_1 | D2_P1_2 | D3_P2_3 | D4_P3_4 | D5_P4_5 | D6_P5_6 |
| TG2 | D0_P5_0 | D2_P1_3 | D3_P2_4 | D4_P3_5 | D5_P4_6 | D6_P5_7 |

TABLE 4-continued

| TX bit | LVDS clock 1 | LVDS clock 2 | LVDS clock 3 | LVDS clock 4 | LVDS clock 5 | LVDS clock 6 |
|---|---|---|---|---|---|---|
| TG3 | D0_P5_1 | D2_P1_4 | D3_P2_5 | D4_P3_6 | D5_P4_7 | D6_P6_2 |
| TG4 | D0_P6_0 | D2_P1_5 | D3_P2_6 | D4_P3_7 | D5_P5_2 | D6_P6_3 |
| TG5 | D0_P6_1 | D2_P1_6 | D3_P2_7 | D4_P4_2 | D5_P5_3 | D6_P6_4 |
| TG6 | D1_P1_2 | D2_P1_7 | D3_P3_2 | D4_P4_3 | D5_P5_4 | D6_P6_5 |
| TH0 | D1_P1_3 | D2_P2_2 | D3_P3_3 | D4_P4_4 | D5_P5_5 | D6_P6_6 |
| TH1 | D1_P1_4 | D2_P2_3 | D3_P3_4 | D4_P4_5 | D5_P5_6 | D6_P6_7 |
| TH2 | D1_P1_5 | D2_P2_4 | D3_P3_5 | D4_P4_6 | D5_P5_7 | D6_P1_0 |
| TH3 | D1_P1_6 | D2_P2_5 | D3_P3_6 | D4_P4_7 | D5_P6_2 | D6_P1_1 |
| TH4 | HSYNC | D2_P2_6 | D3_P3_7 | D4_P5_2 | D5_P6_3 | D6_P2_0 |
| TH5 | VSYNC | D2_P2_7 | D3_P4_2 | D4_P5_3 | D5_P6_4 | D6_P2_1 |
| TH6 | DE | DE | DE | DE | DE | DE |

wherein TE0 . . . TE6, TF0 . . . TF6, TG0 . . . TG6, and TH0 . . . TH6, denote the 7 bits to be provided to LVDS data channels 340, 342, 344, and 346, respectively; and HSYNC, VSYNC, and DE denote bits representing the DE, Hsync, and Vsync values of signals 316.

It will be appreciated that the bit arrangement of Tables 3 and/or 4 may include data of more than one pixel in a clock cycle of clock 324. For example, in clock cycle 1, signal 320 may include data bits of pixel D0; and signals 322 may include data bits of pixels D0 and D1. In clock cycle 5, signal 320 may include data bits of pixels D4 and D5; and signal 322 may include data bits of pixel D5. The Hsync and/or Vsync bits may be transferred, for example, at clock cycle 1, and at an interval of, e.g., six LVDS clock cycles. The DE bits may be transferred, for example, over signals 322, e.g., every LVDS clock cycle. The data bits of signals 320 and/or 322 may be arranged in any other suitable manner.

Figure 4:
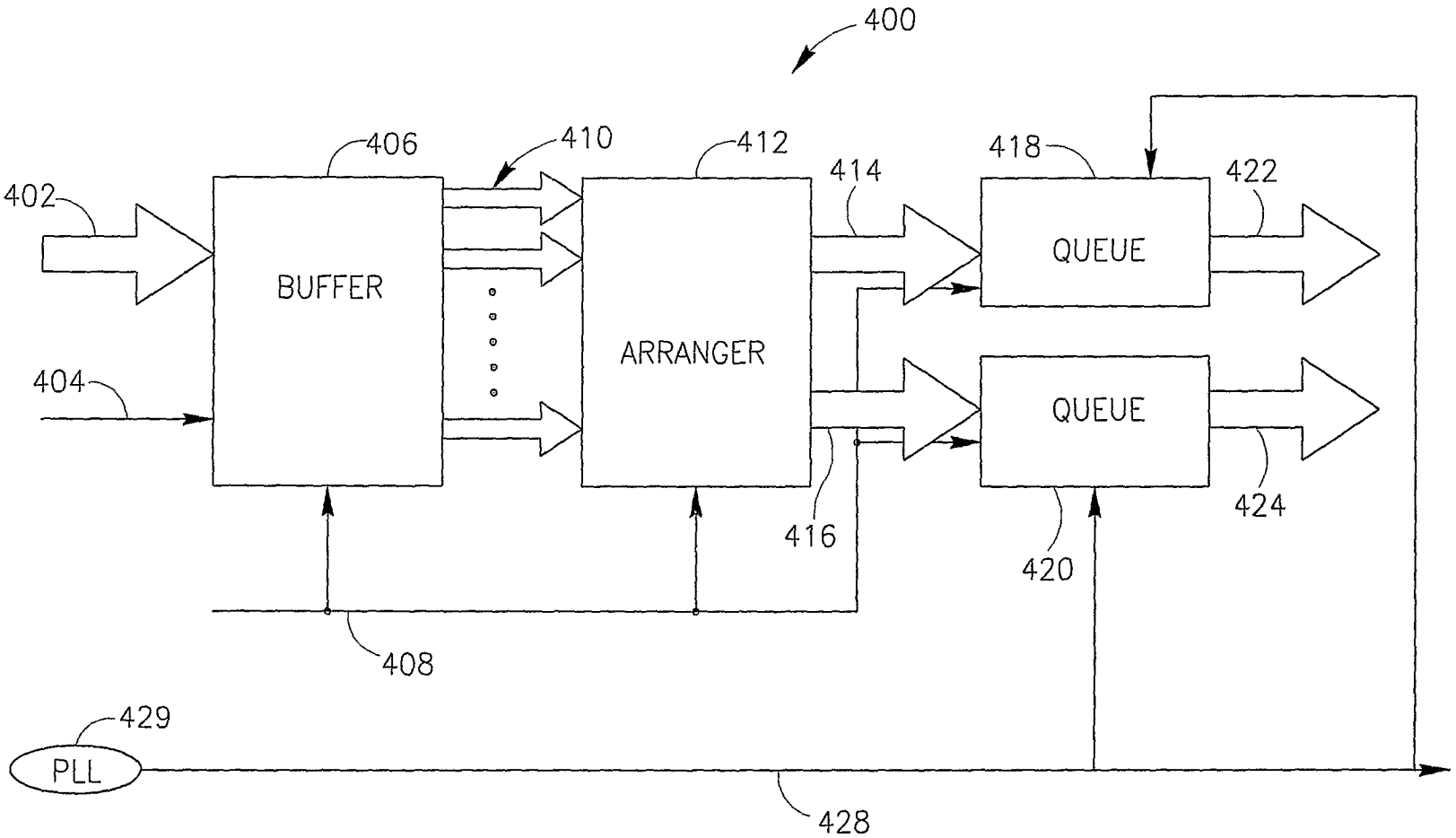
FIG. 4 is a schematic illustration of a formatter in accordance with some demonstrative embodiments of the invention.

Reference is now made to FIG. 4, which schematically illustrates a formatter 400 in accordance with some demonstrative embodiments of the invention. Although the invention is not limited in this respect, formatter 400 may perform the functionality of formatter 202 (FIG. 2).

According to some demonstrative embodiments of the invention, formatter 400 may include a buffer 406, an arranger 412, and/or one or more queues, e.g., queue 420 and/or queue 418, as are described in detail below.

According to some demonstrative embodiments of the invention, buffer 406 may store image bits of data signals 402. Although the invention is not limited in this respect, image data signals 402 may include, for example image data of signals 204 (FIG. 2); and/or control and/or timing signals 208 (FIG. 2). Buffer 406 may receive signals 402 at a rate corresponding to an image data clock signal 404. Although the invention is not limited in this respect, image data clock signal 404 may include, for example, clock signal 206 (FIG. 2).

According to some demonstrative embodiments of the invention, buffer 406 may provide N output signals 410, denoted Data[i], i=1 . . . N, including the bits of signals 402 at a rate corresponding to a system clock signal 408, as described below. System clock signal 408 may include any suitable system clock signal, e.g., as is known in the art. Buffer 406 may include, for example, a register array, e.g., as is known in the art.

According to some demonstrative embodiments of the invention, arranger 412 may arrange the bits of signals 410 in one or more arranged signals, e.g., 414 and 416, according to a predefined scheme, e.g., based on the rate of clock 404, the rate of a transmission clock 428, and/or the format of signals 402, as described in detail below. Transmission clock 428 may be generated, for example, by a Phase Lock Loop (PLL) 429, or any other suitable clock generator.

According to some demonstrative embodiments of the invention, queues 418 and/or 420 may queue the bits of signals 414 and/or 416, respectively. Queues 418 and/or 420 may provide output signals 422 and/or 424, respectively, including the bits of signals 414 and/or 416, respectively, based on transmission clock 428. Queues 418 and/or 418 may include any suitable queues, e.g., First-In-First-Out (FIFO) queues.

According to some demonstrative embodiments of the invention, formatter 400 may be adapted to provide two LVDS transmitters, e.g., LVDS transmitters 214 (FIG. 2), with 56 data bits per clock cycle of clock 428. Accordingly, buffer 406 and/or arranger 412 may be adapted to generate signals 414 and/or 416 including 56 bits of signals 402 per clock cycle of clock 408, e.g., as described in detail below.

According to some demonstrative embodiments of the invention, signals 402 may include, for example, five-primary image data at a bit depth of 8-bits. Signals 402 may also include, for example, three control and/or timing bits representing for example, Hsync, Vsync and DE values, e.g., per clock cycle of clock 404. Accordingly, buffer 406 may receive 5*8+3=43 bits per clock cycle of clock 404. Buffer 406 may be adapted, for example, to store bits of signals 402 during a predefined number of cycles of clock 404. For example, buffer 406 may store 43*13=559 bits of signals 402 during thirteen clock cycles of clock 404. Buffer 406 may be adapted to generate N=10 signals 410, each including, for example, up to 56 bits of signals 402, e.g., every ten clock cycles of clock 404. For example, buffer 406 may generate nine signals of signals 410, each including 56 bits, and a tenth signal including 55 bits. Arranger 412 may arrange the bits received from signals 410, e.g., the 56*9+55=559 bits, in signals 414 and/or 416, such that each of signals 414 and/or 416 transfers up to 56 bits per clock cycle of clock 408. For example, arranger 412 may transfer over each one of signals 414 and/or 416 up to 28 bits of signals 410, during each one of ten clock cycles of clock 408. Queues 418 and/or 420 may queue the bits of signals 414 and/or 416, respectively. Based on transmission clock signal 428, queues 418 and/or 420 may provide signals 422 and/or 424, respectively, each including, for example, up to 28 bits of signals 402.

Figure 5:
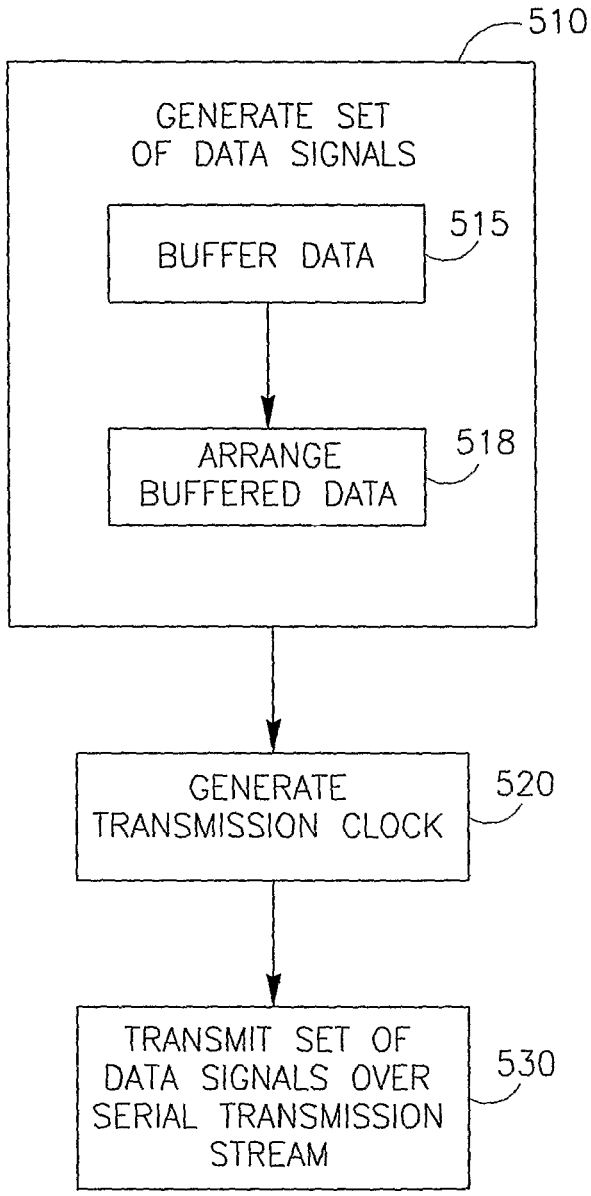
FIG. 5 is a schematic flow-chart illustration of a method of serial data transmission in accordance with some demonstrative embodiments of the invention.

Reference is now made to FIG. 5, which schematically illustrates a method of serial data transmission in accordance with some demonstrative embodiments of the invention. Although the invention is not limited in this respect, one or more operations of the method of FIG. 5 may be performed by system 100 (FIG. 1), transmission scheme 200 (FIG. 2), and/or formatter 400 (FIG. 4).

As indicated at block 510, according to some demonstrative embodiments of the invention the method may include generating a set of one or more data signals including image data received at an image data rate. For example, formatter 202 (FIG. 2) may generate signals 210 (FIG. 2) including image data of signals 204 (FIG. 2), which may be received at a clock rate of clock signal 206 (FIG. 1).

As indicated at block 515, the method may include, according to some demonstrative embodiments of the invention, buffering data corresponding to a predefined number of pixels of the image to be reproduced. For example, buffer 406 (FIG. 4) may buffer data of signals 402 (FIG. 4).

As indicated at block 518, the method may include, according to some demonstrative embodiments of the invention, arranging the buffered data in a predefined arrangement based on one or more attributes of a serial transmission stream intended to transmit the image data. For example, arranger 412 (FIG. 4) may arrange the bits of signals 410 (FIG. 4) in signals 414 (FIG. 4) and/or 416 (FIG. 4), according to a predefined scheme, e.g., based on the rate of clock 404 (FIG. 4), the rate of transmission clock 428 (FIG. 4), and/or the format of signals 402 (FIG. 4).

As indicated at block 520, the method may also include, according to some demonstrative embodiments of the invention, generating a transmission clock signal, wherein during a clock cycle of the transmission clock signal, the set of image data signals may include image data of more than one pixel of the image to be reproduced. For example, formatter 202 (FIG. 2) may generate clock signal 212 (FIG. 2).

As indicated at block 530, the method may also include, according to some demonstrative embodiments of the invention, transmitting the set of data signals over one or more serial transmission streams based on the transmission clock signal. For example, one or more serial transmitters 214 may transmit the data of signals 210 over one or more channels 216 (FIG. 2).

Embodiments of the present invention may be implemented by software, by hardware, or by any combination of software and/or hardware as may be suitable for specific applications or in accordance with specific design requirements. Embodiments of the present invention may include units and sub-units, which may be separate of each other or combined together, in whole or in part, and may be implemented using specific, multi-purpose or general processors, or devices as are known in the art. Some embodiments of the present invention may include buffers, registers, storage units and/or memory units, for temporary or long-term storage of data and/or in order to facilitate the operation of a specific embodiment.

While aspects of the invention has been described with respect to a limited number of embodiments, it will be appreciated in light of the foregoing that many variations, modifications and other applications of the invention may be made. Embodiments of the present invention may include other apparatuses for performing the operations herein. Such apparatuses may integrate the elements discussed, or may comprise alternative components to carry out the same purpose.

What is claimed is:

1. A display system configured to reproduce a color image represented by a received parallel set of digital signals, the system comprising:

a display configured to reproduce said image;

a controller configured to control said display based on serial image data signals received by the controller, the serial image data representing said image; and a serial re-transmission unit configured to transfer over a serial link said serial image data signals to said controller, wherein the serial re-transmission unit includes:

a formatter configured to generate from the received parallel set of digital signals, a set of one or more reformatted data signals including said image data received at an image data rate; and a serial transmission clock signal generator configured to generate a serial transmission clock signal having a clock cycle during which each set of image data signals includes only a part of the data of at least one pixel of the image to be reproduced.

2. The system of claim 1, wherein said image data comprises image data in terms of at least three primary colors.

3. The system of claim 2, wherein said image data comprises image data in terms of at least four primary colors.

4. A method of re-transmitting information of a received plurality of image frames in a manner which allows timely production at a receiving destination of an image represented by the re-transmitted image frames information, the method comprising:

receiving first digital data signals representing plural ones of M pixels by N pixels image frames, M and N being whole numbers, where the received first digital data signals are organized and initially grouped as a first number, P of image-defining bits per pixel optionally combined with a second number, Q of control-defining bits per pixel, the received first digital data signals having a receipt rate corresponding to receipt of F frames per unit of time;

providing a serial data link having at least one clock channel and a plurality of B-bit wide serial data channels each having a predetermined maximum transmission rate of X clock cycles per second when B bits are being transmitted per clock cycle per channel, where for given whole numbers J and K, the product J times (P plus Q), where Q can be zero, is not equal to K times B and thus transmission of undivided groups of (P plus Q) bits by way of K ones of the B-bit wide serial data channels will result in some bit slots of the serial transmission being empty during such transmission if the received first digital data signals are re-transmitted as undivided initial groups of (P plus Q) bits by way of K ones of the B-bit wide serial data channels;

reformatting the received first digital data signals into W bundles of data, W being a natural number, with each bundle being a B-bit wide word that is transmittable via a respective channel in one clock cycle of the serial data link, said reformatting causing a split up across plural ones of the serial data link clock cycles of at least some of the initial groups of (P plus Q) bits;

serially transmitting the reformatted data over plural channels of the serial data link and at a rate equal to or less than the predetermined maximum pre-channel transmission rate X of the serial data link so as to obtain benefit of the respective full bandwidth of each used channel while providing a serial transmission rate at least as great as that corresponding to the receipt of F frames per said unit of time so that timely production of an image represented by the re-transmitted image frames information at the receiving destination is enabled by said serial transmitting of the reformatted data.

5. The method of claim 4 wherein P equals 24 and Q equals 3.

6. The method of claim 4 wherein B equals 7.

7. The method of claim 4 wherein X corresponds to 135 MHz per channel.

8. The method of claim 7 wherein the initial frames receipt rate F corresponds to pixel data rate of 148.5 MHZ being transmitted over a channel.

9. The method of claim 4 wherein the predetermined maximum pre-channel transmission rate X of the serial data link is selected so as to keep electro-magnetic interference (EMI) below a predetermined level.

10. The method of claim 4, wherein said serial data link is capable of outputting one or more serial transmission streams as a respective one or more low voltage differential signaling streams.

11. The method of claim 10, wherein one or more of said low voltage differential signaling streams comprise at least four low voltage differential signaling channels and wherein said serially transmitting the reformatted data over plural channels comprises transmitting over one or more of said four low voltage differential signaling channels, where the B bits is seven bits of said image data during each said clock cycle.

12. The method of claim 4, wherein said serial data link is capable of outputting two or more serial transmission streams, and wherein the method comprises transmitting said transmission clock signal only over a number of serial channels smaller than the used number of said streams.

13. The method of claim 4 and further comprising:

prior to said reformatting of the received first digital data signals, buffering at least some of the received first digital data signals corresponding to a predefined number of pixels of the image to be reproduced; and wherein the reformatting include reformatting the buffered data in a predefined arrangement based on one or more attributes of serial link.

14. The method of claim 13, wherein said predefined number of pixels relates to said image data rate.

15. The method of claim 4, wherein said receipt rate corresponding to receipt of R pixels per unit of time is higher than the utilized rate of transmission used when serially transmitting the reformatted data over the plural channels of the serial data link and at said rate that is equal to or less than the per channel maximum transmission rate X of the serial data link.

16. The method of claim 4, wherein said received image data comprises image data in terms of at least three primary colors.

17. The method of claim 16, wherein said image data comprises image data in terms of at least four primary colors.

18. The method of claim 16, wherein said received image data comprises image data having a bit depth of at least eight bits per primary color.

19. The method of claim 4, wherein each said set of image data signals includes complete image data of at least a first pixel of the image to be reproduced and only partial image data of at least a second , pixel of the image to be reproduced.

20. An apparatus for re-transmitting information of a received plurality of image frames in a manner that allows timely production at a receiving destination of an image represented by the re-transmitted image frames information, the method comprising:

an input unit configured for receiving first digital data signals representing plural ones of M pixels by N pixels image frames where the received first digital data signals are organized and initially grouped as a first number, P of image-defining bits per pixel optionally combined with a second number, Q of control-defining bits per pixel, the received first digital data signals having a receipt rate corresponding to receipt of F frames per unit of time;

a serial data link having at least one clock channel for carrying a serial transmission clock signal and a plurality of B-bit wide serial data channels each having a predetermined maximum transmission rate of X clock cycles per second and enabling B bits to be transmitted per clock cycle per channel, where for given whole numbers J and K, the product J times (P plus Q) is not equal to K times B and thus transmission of undivided groups of (P plus Q) bits by way of K ones of the B-bit wide serial data channels will result in some bit slots being empty during such transmission if the received first digital data signals are re-transmitted by the serial data link as undivided groups of (P plus Q) bits by way of K ones of the B-bit wide serial data channels; and a data reformatter configured for reformatting the received first digital data signals into W bundles of data each being a B-bit wide word that is transmittable via a respective channel in one clock cycle of the serial data link, said reformatting causing a split up across plural ones of the serial data link clock cycles of at least some of the groups of (P plus Q) bits;

wherein the data reformatter is operatively coupled to the serial data link and configured so as to cause serial transmitting of the reformatted data over plural channels of the serial data link and at a rate equal to or less than the predetermined maximum pre-channel transmission rate X of the serial data link so as to obtain benefit of the respective full bandwidth of each used channel while providing a serial transmission rate at least as great as that corresponding to the receipt of F frames per said unit of time so that timely production of an image represented by the re-transmitted image frames information at the receiving destination is allowed by said serial transmitting of the reformatted data.

21. The apparatus of claim 20, wherein said serial data link comprises one or more low voltage differential signaling transmitters configured to transmit said set of reformatted data signals as a corresponding one or more low voltage differential signaling streams and wherein one or more of said low voltage differential signaling streams comprises at least four low voltage differential signaling channels.

22. The apparatus of claim 21, wherein one or more of said transmitters are able to transmit over one or more of said channels seven bits of said image data during said clock cycle.

23. The apparatus of claim 21, wherein said one or more differential signaling transmitters are configured to transmit two or more serial transmission streams, and wherein said one or more transmitters are able to transmit said serial transmission clock signal over a number of serial channels smaller than a number of said streams.

24. The apparatus of claim 21, wherein said formatter comprises:

a buffer to buffer data corresponding to a predefined number of pixels of the image to be reproduced; and an arranger to arrange the buffered data in a predefined arrangement based on one or more attributes of a serial transmission stream intended to transmit said image data.

25. The apparatus of claim 21, wherein said image data rate is higher than a rate of said serial transmission clock signal.

26. The apparatus of claim 21, wherein said image data comprises image data in terms of at least three primary colors.

27. The apparatus claim 26, wherein said image data comprises image data in terms of at least four primary colors.

28. The apparatus of claim 21, wherein said image data comprises image data having a bit depth of at least eight bits.

* * * * *